US006776169B1

(12) United States Patent
Zou et al.

(10) Patent No.: US 6,776,169 B1
(45) Date of Patent: Aug. 17, 2004

(54) GINKGO BILOBA L. LEAVES CIGARETTE

(76) Inventors: Yong Zou, Shandong Institute for Product Quality Supervision & Inspection 81, Shandabei Road, Jinan City, Shandong 250100 (CN); Qiang Zou, Shandong Institute for Product Quality Supervision & Inspection 81, Shandabei Road, Jinan City, Shandong 250100 (CN)

( * ) Notice: Subject to any disclaimer, the term of this patent is extended or adjusted under 35 U.S.C. 154(b) by 0 days.

(21) Appl. No.: 09/529,653

(22) PCT Filed: Sep. 30, 1998

(86) PCT No.: PCT/CN98/00209

§ 371 (c)(1),
(2), (4) Date: Jun. 26, 2000

(87) PCT Pub. No.: WO99/20131

PCT Pub. Date: Apr. 29, 1999

(30) Foreign Application Priority Data

Oct. 17, 1997 (CN) ..... 97106146 A

(51) Int. Cl.[7] ..... A24B 15/00
(52) U.S. Cl. ..... 131/359; 131/360; 131/270
(58) Field of Search ..... 131/270, 352, 131/359, 360, 347, 369

(56) References Cited

U.S. PATENT DOCUMENTS 3,369,552 A * 2/1968 Carroll ..... 131/369
3,820,548 A * 6/1974 Buchmann et al. ..... 131/369

FOREIGN PATENT DOCUMENTS

| | | |
|---|---|---|
| CN | 1066173 | * 11/1992 |
| CN | 1140036 | * 1/1997 |
| CN | 11400036 | * 1/1997 |
| JP | 8266261 | * 10/1996 |
| JP | 08-266261 | * 10/1996 |

* cited by examiner

*Primary Examiner*—Dionne A. Walls
(74) *Attorney, Agent, or Firm*—Jian Liu

(57) ABSTRACT

This invention provides a kind of cigarette substitute which is called Ginkgo Biloba L. leaves cigarette. It not only has the function of refreshing, but also is good to people's health. It avoids the harm which is brought to human bodies by the poisonous substances in tobacco. Because Ginkgo biloba L. leaves contain a large amount of flavenoids and Ginkgolide which are good to human bodies, and these pharmaceutical active ingredients are easy to volatilize and can be absorbed into lung, then good effects will be done. The smoke of this kind of cigarette is soft and dense, and it can prevent and cure hypertension, heart disease, arterio-sclerosis and senile dementia disease. This kind of cigarette can be produced by ordinary technology.

6 Claims, No Drawings

GINKGO BILOBA L. LEAVES CIGARETTE

TECHNOLOGY FIELD OF THE INVENTION

This invention relates to a kind of cigarette substitute, particularly, a Ginkgo biloba L. leaves cigarette in order to provide a new kind of cigarette for society.

BACKGROUND OF THE INVENTION

Many investigations and experiments have proved that smoking is harmful to people's health.

While all the governments of the world are advocating quitting smoking and making laws to limit the producing and selling of cigarettes, scientists and tobacco technicians are making efforts to study how to lessen the cigarette's harm and develop low harm or harmless cigarettes. It is because of the fact that there are too many smokers, the complete prohibition of smoking has achieved little effect. On social effect and economic return, the contradictions, smoking and health, are still existing.

In the field of production, the filter technology is usually adopted to eliminate the poisonous substances from cigarettes. Most kinds of cigarette filters are made of active charcoal fibre or vinegar acidity fibre (see CN2174854Y and CN/088763A). Another method is in connection with the cut tobacco itself. That is, to treat the cut tobacco by a special process (see CN 1045515A).

However, these ordinary methods mentioned above cannot solve the problems thoroughly.

To prevent and cure diseases, people have so far developed an Argy wormwood leaf cigarette, a Tea cigarette, a Fiveleaf Gynostemma Herb cigarettes and a mixed herbal cigarette which is produced by adding eucalyptus, Dogbance leaf, Pilose Asiabell Root, Wild Mint Herb, Slenderstyle Acanthopanax Root-bark, Changbai Ginseng, Fritillary Bulb, Milkvetch Root, Tremella, Lucid Ganoderma, Radish, Dwarf Lilyturf Tuber, Tall Gastraodia Tuber, Eucommia Bark, Hempleaf Negundo Chastetree, Coral and Ginger into tobacco. However, these cigarettes are not satisfactory with respect to cost, medical effect, and low poisonousness. People are trying to develop a new kind of cigarette substitute which is satisfactory in the respects of cost, taste and poisonousness.

Ginkgo biloba L., which is dioecious, is of gymnosperm. It originally grew in China. Ginkgo biloba L. is the oldest tree species in the world, even older than the dinosaur, so it is called a "live fossil". It has great vitality. In 1966 German scientist W. Schwabe discovered that Ginkgo biloba L Leaves contain some active substances-Flavonoids and Ginkgolide, which can prevent and care for angiocardiopathy and nerve system diseases. From then on, the modem study on Ginkgobiloba L. Leaves' pharmacological property and application began. Scientific researchers proved that Ginkgo biloba L. leaves contain a large amount of flavonoids and Ginkgolide A, B and C. Flavonoides are especially effective in curing angiocardiopathy and are widely used at present. The can make the sclerosed blood vessels recover elasticity, improve the brittleness of blood vessels, dilate blood vessels and prevent the atrophy of organ functions caused by the bad circulation of blood. Ginkgolide is a specific platelet activating factor antagonist. (PAF is one of the mediums of the paroxysm of many diseases.) It has the functions of making blood active and minimizing the cholesterin content in blood. It also can be used to prevent and cure the allergic diseases of breath tract. Bilobalide can straighten out cranial nerve streak and has the functions of refreshing, resisting fatigue and intensifying memory. In 1991, a Harvard scholar won the Nobel Prize for successfully synthesizing Bilobalide in a laboratory. Scientists and medical experts have proved by animal experiments that many pharmaceutical substances in Ginkgo biloba L. leaves have important effects on deterring senescence and resisting diseases. Therefore, many developed countries such as America, Korea and some European countries are speeding up to develop Ginkgo biloba Extract.

In China, several kinds of Ginkgo biloba medicines have been developed. China is the main producing country of Ginkgo biloba L. leaves. However, the development on Ginkgo biloba L. leaves product is still in its beginning stages.

Ginkgo biloba L. leaves contain plentiful fibres. The cigarette substitute made of dry Ginkgo biloba L. leaves burns continuously and fully. Its ashes are white and fine. Its smoke is soft and dense. Its taste is good and its smell is fragrant and sweet. Its pharmaceutical active ingredients volatilize continuously at the same time of burning.

As a cigarette substitute, the Ginkgo biloba L. leaves cigarette also has obvious function of refreshing, but its principle is different from that of the ordinary cigarette. The smoke of the ordinary cigarette contains nicotine which can stimulate brain nerves and make people become addicted to it. The smoke of Ginkgo biloba L. leaves cigarette contains Bilobalide and other pharmaceutical active ingredients which can stimulate the brain nerve and straighten out the cranial nerve system, thus having function of refreshing and resisting fatigue. It doesn't contain any nicotine at all. Therefore, the Ginkgo biloba L. leaves cigarette is not only an excellent cigarette substitute, but also an ideal product for quitting smoking. A tobacco addict can successfully quit smoking with no agony by smoking Ginkgo biloba L. cigarette.

In view of the above-mentioned factors, Ginkgo biloba L. leaves can be good for human bodies. It contains the pharmaceutical active ingredients which can volatize easily and its smokable property is similar to tobacco cigarette, so it is hopeful that it will take the place of the cigarette which contains nicotine.

A poisonousness-reduced cigarette and its producing process are disclosed in reference CN1140036A. This kind of cigarette contains the solution extract of Ginkgo biloba L. leaves, Leech, Szechwan Lovage Rhizome and three other substances. What is worth mentioning is that the substances mentioned above are sprayed onto the cut tobacco in the form of a solution.

After the long-period study of the inventor, a kind of Ginkgo biloba L. leaves cigarette has been developed. The raw material is Ginkgo biloba L. leaves, containing little or no tobacco. Therefore it is good for people's health and is completely different from the cigarette introduced in reference CN1140036A. As mentioned above, the cigarette's raw material of the latter is tobacco, and the solution extract is sprayed onto its surface. It is obvious that the nicotine content can not be lowered at all.

SUMMARY OF THE INVENTION

The object of this invention is to produce a Ginkgo biloba L. leaves cigarette using Ginkgo biloba L. leaves and to provide people with a kind of cigarette substitute which has the functions of the ordinary cigarette, while it is good for people's health. It will help people get away from tobacco and avoid the harm brought by smoking. Ginkgo biloba L.

leaves are the main material of this kind of cigarette, and, if necessary, tobacco or other tobacco-used herbs can optionally be added therein according to special requirements.

DETAILED DESCRIPTION OF THE PREFERRED EMBODIMENTS

One embodiment of this invention is to pick fresh Ginkgo biloba L. leaves from trees, process them into threads, then replace tobacco with 100 wt % dry material of this kind. Another embodiment is to blend dry Ginkgo biloba L. leaves with a percentage of more than 50 weight and tobacco or other tobacco-used herbs with a percentage of less than 50 weight together.

The process therefor includes producing pure Ginkgo biloba L. leaves cigarette or complex Ginkgo biloba L. leaves cigarette by means of the ordinary process for producing cigarette.

EXAMPLE 1

Use dry processed Ginkgo biloba L. leaves, flue-cure them, then cut them into threads after being moist-cured by means of the ordinary process for producing cigarettes.

The pure Ginkgo biloba L. leaves cigarette is produced by this method.

EXAMPLE 2

Use dry processed Ginkgo biloba L. leaves, flue-cure them, then cut them into threads or pieces after being moist-cured. Using the ordinary cigar wrappers, the Ginkgo biloba L. leaves cigar can be produced.

EXAMPLE 3

Use dry processed Ginkgo biloba L. leaves 50 Kg, cut them into threads or pieces after being moist-cured, then add ordinary tobacco 5 Kg, then blend them together. By means of the ordinary process for producing cigarettes, the mixed cigarettes can be produced.

EXAMPLE 4

Use processed Ginkgo biloba L. leaves 50 kg, cut them into threads or pieces after moist-cured, then add wild mint or Fiveleaf Erynostemma 15 kg, then blend them together, add therein different scent of perfumes and accretions if needed. By means of the ordinary process for producing cigarette, another mixed cigarette can be produced.

TEST EXAMPLE 1

1. Object of the Test

To test mouse peroral toxicity of Ginkgo biloba L. leaves cigarette.

2. Material and Method: Horn Method is Adopted

Use Mice of Qunming (a province of China) species provided by standard animal laboratory, 18~21 g weight, and half male and half female. The samples to be tested are made up with distilled water, orally filled into the stomach in one dose, and observe them for one week.

3. Result

| dosage | 10000 | 4640 | 2150 | 1000 mg/Kg |
|---|---|---|---|---|
| female | 0/5 | 0/5 | 0/5 | 0/5 |
| male | 0/5 | 0/5 | 0/5 | 0/5 |

Adopting Horn method, th e result is as below: LD50 of this sample is higher than 10000 mg/Kg.

4. Conclusion: The Sample is Non-toxic

Test Example 2: Flue gas analysis.

Test Content: Nicotine content.

Based Standards of Test: GB/T5606.1 5606.2-1996
GB5606.3-5606.6-1996
YC/T28.28.12-1996

Average Smoke Times: 14.6

Moisture Content (mg/cigarette): 2.24

Nicotine (mg/cigarette): 0.00

Conclusion: There is no nicotine in the smoke.

Industrial Applicability

Because the flavolides, Ginkgolide and bilobalide contained in Ginkgo biloba L. leaves are easy to volatilize, and while the cigarette is burning the temperature is becoming lower and lower from the burning end to the filter, the pharmaceutical active ingredients contained in the cigarette can volatilize with smoke before being destroyed by being overheated. These ingredients are absorbed into the human body and go into the blood circulation by the lung. Smoking Ginkgo biloba L. leaves have obvious effects on preventing hypertension and angiocardiopathy, recovering from fatigue, refreshing, stimulating appetite and improving sleep. Long-term smoking of this kind of cigarette substitute can prevent and cure senile dementia disease, hypertension, heart disease, arteriosclerosis, cerebral and brain function failing. It is helpful to intensify memory, build up a good physique and deter senescence.

The pure Ginkgo biloba L. leaves cigarette has a good taste, the passive smoker can easily smell its fragrance. As containing no tobacco, it can avoid the harm brought by nicotine and can be used as an ideal product for quitting smoking the tobacco cigarette.

Therefore, the invention of Ginkgo biloba L. leaves is very important to solve the problems of smoking and passive smoking. The Ginkgo biloba L. leaves can be picked artificially. The cigarettes can be produced with ordinary technology. What is more important is that its application can bring us great social effects and economic returns.

What is claimed is:

1. A cigarette comprising a main body and a filter attached to one end of the said main body, wherein the said main body comprises 50–100% by weight Ginkgo biloba leaves.

2. A cigarette according to claim 1, wherein the main body comprises more than 90% by weight Ginkgo biloba leaves.

3. A cigar comprising burnable material, wherein the burnable material comprises 50–100% by weight Ginkgo biloba leaves.

4. A cigar according to claim 3, wherein the burnable material comprises more than 90% by weight Ginkgo biloba leaves.

5. A method for quitting smoking comprising the step of smoking a cigarette comprising a main body and a filter attached to the said main body, wherein the main body comprises 50–100% by weight Ginkgo biloba leaves.

6. A method according to claim 5, wherein the said main body comprises more than 90% by weight Gingko biloba leaves.

* * * * *